US012349774B2

(12) United States Patent
Kim

(10) Patent No.: US 12,349,774 B2
(45) Date of Patent: Jul. 8, 2025

(54) STORAGE CONTAINER

(71) Applicant: Sang-Hoon Kim, Incheon (KR)

(72) Inventor: Sang-Hoon Kim, Incheon (KR)

( * ) Notice: Subject to any disclaimer, the term of this patent is extended or adjusted under 35 U.S.C. 154(b) by 44 days.

(21) Appl. No.: 18/264,454

(22) PCT Filed: Jan. 28, 2022

(86) PCT No.: PCT/KR2022/001552

§ 371 (c)(1),
(2) Date: Aug. 7, 2023

(87) PCT Pub. No.: WO2022/169214

PCT Pub. Date: Aug. 11, 2022

(65) Prior Publication Data

US 2024/0099436 A1 Mar. 28, 2024

(30) Foreign Application Priority Data

Feb. 8, 2021 (KR) ..... 10-2021-0017628

(51) Int. Cl.
*A45C 11/24* (2006.01)
*A45C 13/00* (2006.01)
(Continued)

(52) U.S. Cl.
CPC ..... *A45C 11/24* (2013.01); *A45C 13/005* (2013.01); *A45C 13/30* (2013.01); *A45F 3/02* (2013.01)

(58) Field of Classification Search
CPC ..... A45C 11/24; A45C 13/005; A45C 13/30; A45F 3/02; B65D 11/10; B65D 11/105
(Continued)

(56) References Cited

U.S. PATENT DOCUMENTS 4,761,853 A * 8/1988 Hoffman ..... E05F 1/12 16/302
4,892,189 A * 1/1990 Kunimune ..... G11B 33/0438 D6/626
(Continued)

FOREIGN PATENT DOCUMENTS

JP 2005112449 A 4/2005
KR 200175918 Y1 3/2000
(Continued)

OTHER PUBLICATIONS

International Search Report dated Jun. 2, 2022 in International Application No. PCT/KR2022/001552.

*Primary Examiner* — Orlando E Aviles
*Assistant Examiner* — Niki M Eloshway
(74) *Attorney, Agent, or Firm* — SALIWANCHIK, LLOYD & EISENSCHENK

(57) ABSTRACT

Proposed is a storage container configured such that, depending on an article to be stored or the purpose of use, a user can freely determine and change an opening direction or the location of accessories. The storage container includes a cord member provided along an outer edge of an outer body in the shape of a plate or a hollow vessel, forming the exterior of the storage container, and an axis-determining clip configured to couple to cord members provided on each of adjacent outer bodies so as to be penetrated at once wherein as the axis-determining clip is coupled to at least one side among a plurality of sides forming the cord member, the outer body coupled by the axis-determining clip can be rotated about the axis-determining clip, thereby opening the storage container.

3 Claims, 12 Drawing Sheets

(51) Int. Cl.
*A45C 13/30* (2006.01)
*A45F 3/02* (2006.01)

(58) Field of Classification Search
USPC ..... 220/4.22, 845, 847, 685
See application file for complete search history.

(56) References Cited

U.S. PATENT DOCUMENTS 5,069,354 A * 12/1991 Tannenbaum ..... B65D 11/188 190/122
5,375,734 A * 12/1994 Tiramani ..... A45C 13/04 220/531
5,603,402 A * 2/1997 Cuneo ..... B65D 43/168 220/756
5,782,371 A * 7/1998 Baerenwald ..... B65D 43/168 220/4.24
5,991,975 A * 11/1999 Baer ..... E05D 7/009 16/354
6,003,716 A * 12/1999 Allison ..... B60R 7/04 220/326
6,979,777 B2 * 12/2005 Marcou ..... H02G 3/14 220/241
8,517,196 B2 * 8/2013 Chang ..... B42F 7/14 206/451
9,694,951 B2 * 7/2017 Friedland ..... B65D 45/02
2006/0283870 A1 * 12/2006 Au ..... B65D 43/168 220/4.22
2007/0039973 A1 * 2/2007 Boenig ..... A45C 13/26 220/847

FOREIGN PATENT DOCUMENTS

KR 10-20060128254 A 12/2006
KR 10-20160078339 A 7/2016
KR 10-20170039123 A 4/2017

* cited by examiner

STORAGE CONTAINER

CROSS-REFERENCE TO RELATED APPLICATIONS

This application is the U.S. national stage application of International Patent Application No. PCT/KR2022/001552, filed Jan. 28, 2022, which claims the benefit under 35 U.S.C. § 119 of Korean Application No. 10-2021-0017628, filed Feb. 8, 2021, the disclosures of each of which are incorporated herein by reference in their entirety.

TECHNICAL FIELD

The present disclosure relates to a storage container and, more particularly, to a storage container configured such that, depending on an article to be stored or the purpose of use, a user can optionally change and set an opening direction.

BACKGROUND ART

Generally, a storage container means an item that stores and manages an article, and a bag or a case is also referred to as the storage container. Such a storage container is usually configured in consideration of the size or shape of an article that is to be stored, and is configured such that a portion thereof is opened or closed to put or take the article therein or therefrom.

The openable storage container is configured to be opened or closed in a predetermined direction when the storage container is manufactured. Thus, since it is impossible to change an opening or closing direction depending on the type of an article or a user's need, the user should prepare different storage containers depending on the type of the article or the purpose of use.

Further, a handle for holding the storage container by hand or a strap for carrying the storage container on the shoulder is also provided at a predetermined location when the storage container is manufactured. Thus, since it is difficult for the user to optionally change the location of the accessory, such as the handle or the strap, as needed, the same storage container has a uniform use pattern.

DISCLOSURE

Technical Problem

The present disclosure has been made to solve the above-mentioned problems and difficulties, and an objective of the present disclosure provides a storage container configured such that, depending on an article to be stored or the purpose of use, a user can freely determine and change an opening direction or the location of accessories.

Technical Solution

In order to accomplish the above objective, the present disclosure provides a storage container capable of setting an opening direction, which includes a cord member provided along an edge of an outer body in a shape of a plate or a hollow vessel while forming an appearance of the storage container, and an axis-determining clip coupled to cord members provided, respectively, on adjacent outer bodies so that the cord members simultaneously penetrate therethrough, whereby the axis-determining clip is coupled to at least one side among a plurality of sides forming the cord member.

Further, the axis-determining clip may include a first through hole and a second through hole that are formed in a longitudinal direction thereof so that the cord members provided on one outer body and the other outer body adjacent thereto pass therethrough, and a first fitting hole and a second fitting hole that are formed in a widthwise direction thereof so that the first through hole and the second through hole communicate with the outside, whereby the axis-determining clip may be fitted over the cord member through each of the first fitting hole and the second fitting hole.

Further, the first fitting hole and the second fitting hole may be formed to face the cord member of one outer body and the cord member of the other outer body.

The storage container may further include a finishing clip coupled to a portion of the cord member to which the axis-determining clip is not coupled, without interfering with rotation of the outer body by the axis-determining clip.

Further, the cord member may be provided along an outer edge of the outer body, and the storage member may further include a strap fixing clip to which the cord member provided on at least one outer body among the adjacent outer bodies is coupled to penetrate therethrough and which may fix a strap.

Advantageous Effects

According to the present disclosure, outer bodies coupled by an axis-determining clip may be rotated about the axis-determining clip to open a storage container, so that a user may select at least one side among a plurality of sides forming a cord member as a rotation axis for opening the storage container and then may couple the axis-determining clip thereto, thus allowing an opening direction to be changed depending on the type of an article that is to be stored or the purpose of use.

Further, a finishing clip inhibits a portion of a cord member to which an axis-determining clip is not coupled from being exposed, thus securing a good appearance, and a strap fixing clip allows a user to optionally determine a strap for holding or carrying the storage container by hand or on the shoulder, thus increasing the convenience of use.

BEST MODE

According to the present disclosure, in order for a user to freely determine and change an opening direction or the location of accessories depending on an article to be stored or the purpose of use, a storage container includes a cord member provided along an edge of an outer body in a shape of a plate or a hollow vessel while forming an appearance of the storage container, and an axis-determining clip coupled to cord members provided, respectively, on adjacent outer bodies so that the cord members simultaneously penetrate therethrough, whereby, as the axis-determining clip is coupled to at least one side among a plurality of sides forming the cord member, the outer body coupled by the axis-determining clip is rotated about the axis-determining clip, thereby opening the storage container.

The present disclosure is not limited to embodiments described below, and can be variously modified by those skilled in the art without departing from the technical sprit of the present disclosure.

Hereinafter, a storage container of the present disclosure will be described in detail with reference to FIGS. 1 to 11.

As shown in FIGS. 1 to 11, the storage container according to the present disclosure includes a cord member 100 provided along an edge of an outer body 10 that defines the appearance of the storage container, and an axis-determining clip 200 coupled to the cord member 100.

Figure 1:
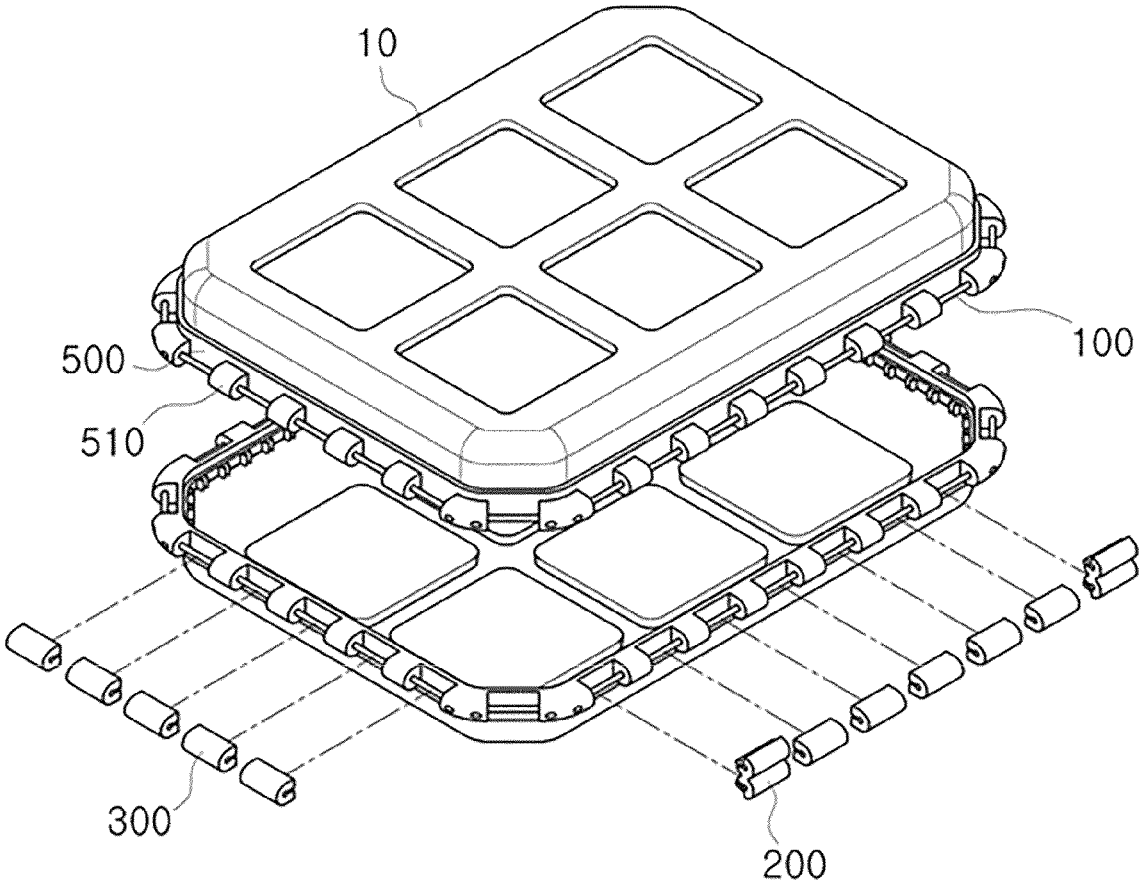
FIG. 1 is an exploded perspective view of a storage container according to a first embodiment of the present disclosure.
Figure 2:
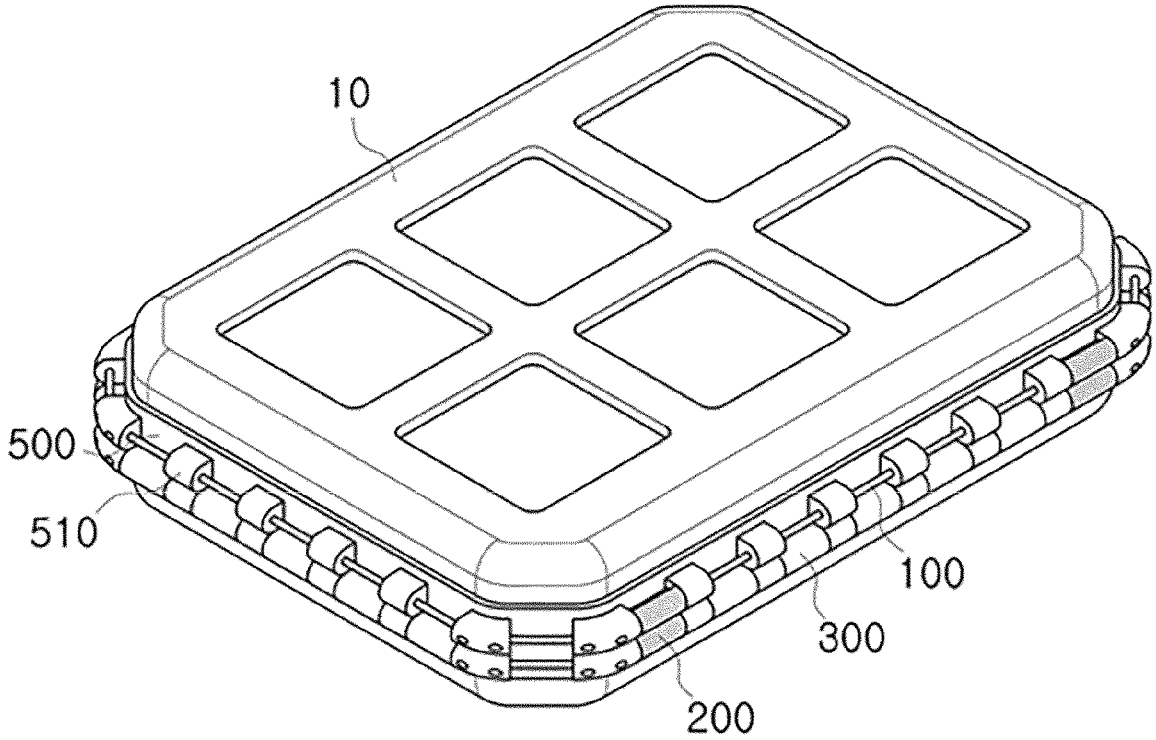
FIG. 2 is an assembled perspective view of the storage container according to the first embodiment of the present disclosure.
Figure 9:
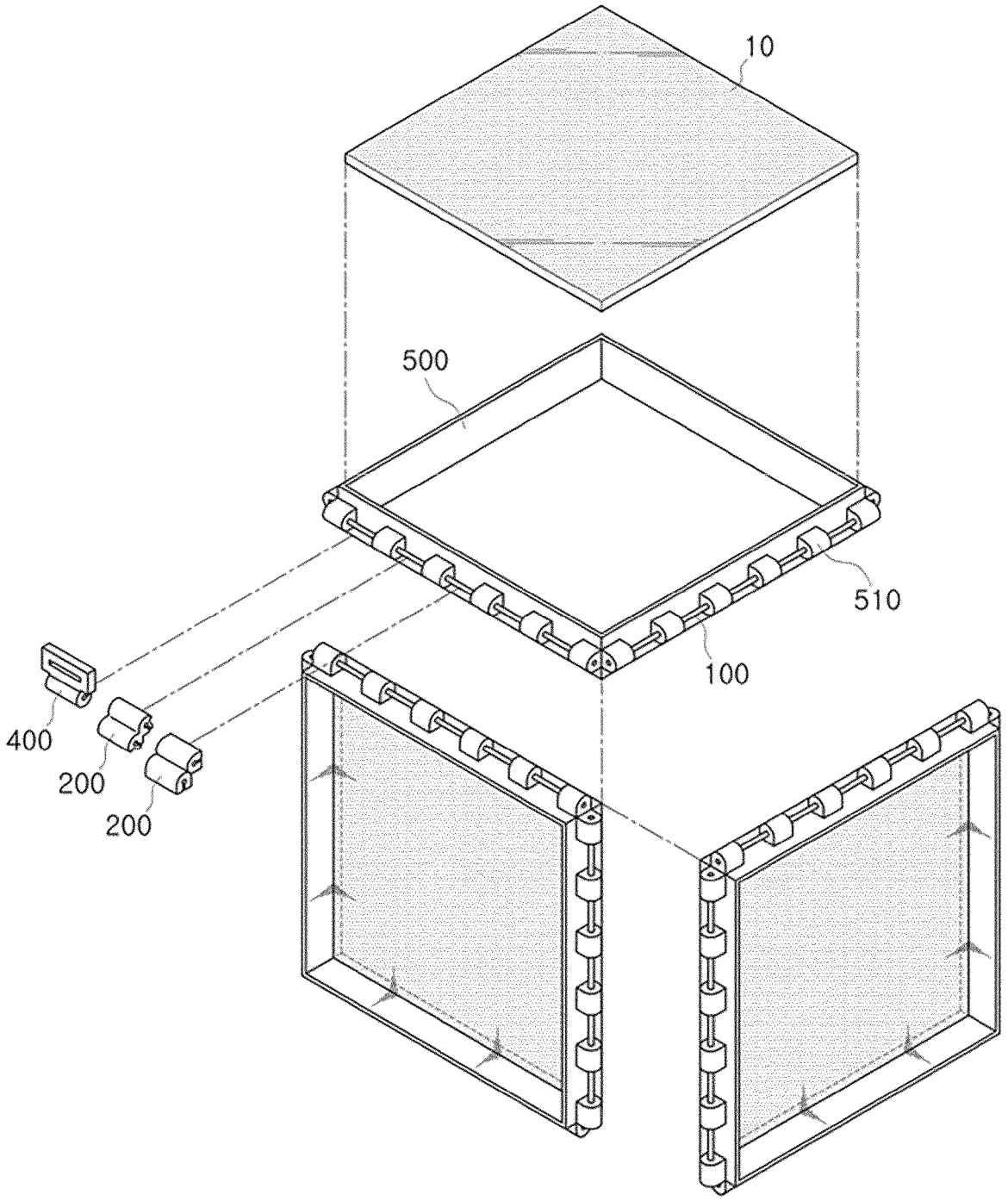
FIG. 9 is an exploded perspective view of components for assembling a storage container according to a second embodiment of the present disclosure.
Figure 10:
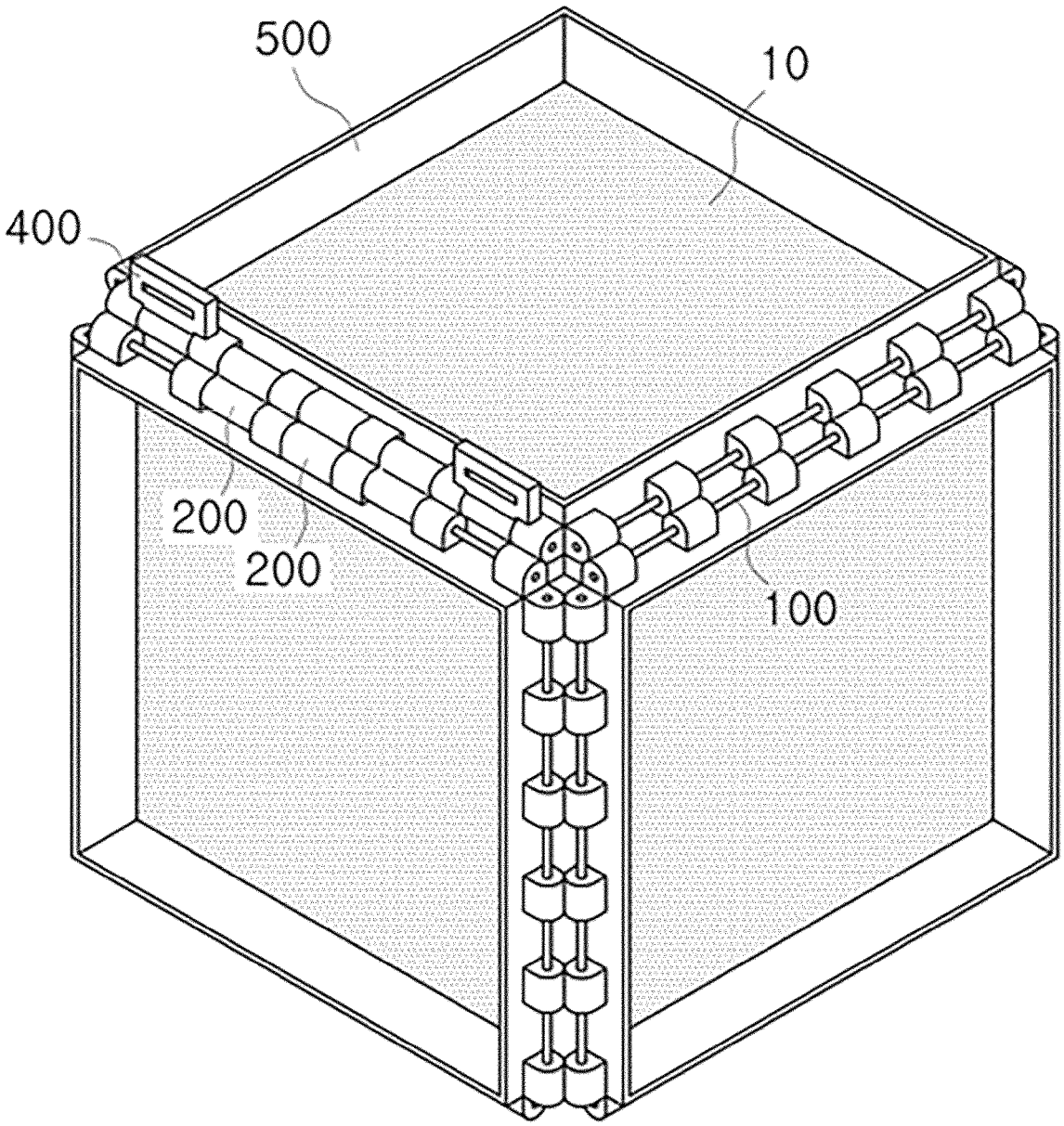
FIG. 10 is a perspective view showing a state in which the storage container according to the second embodiment of the present disclosure is partially assembled.
Figure 11:
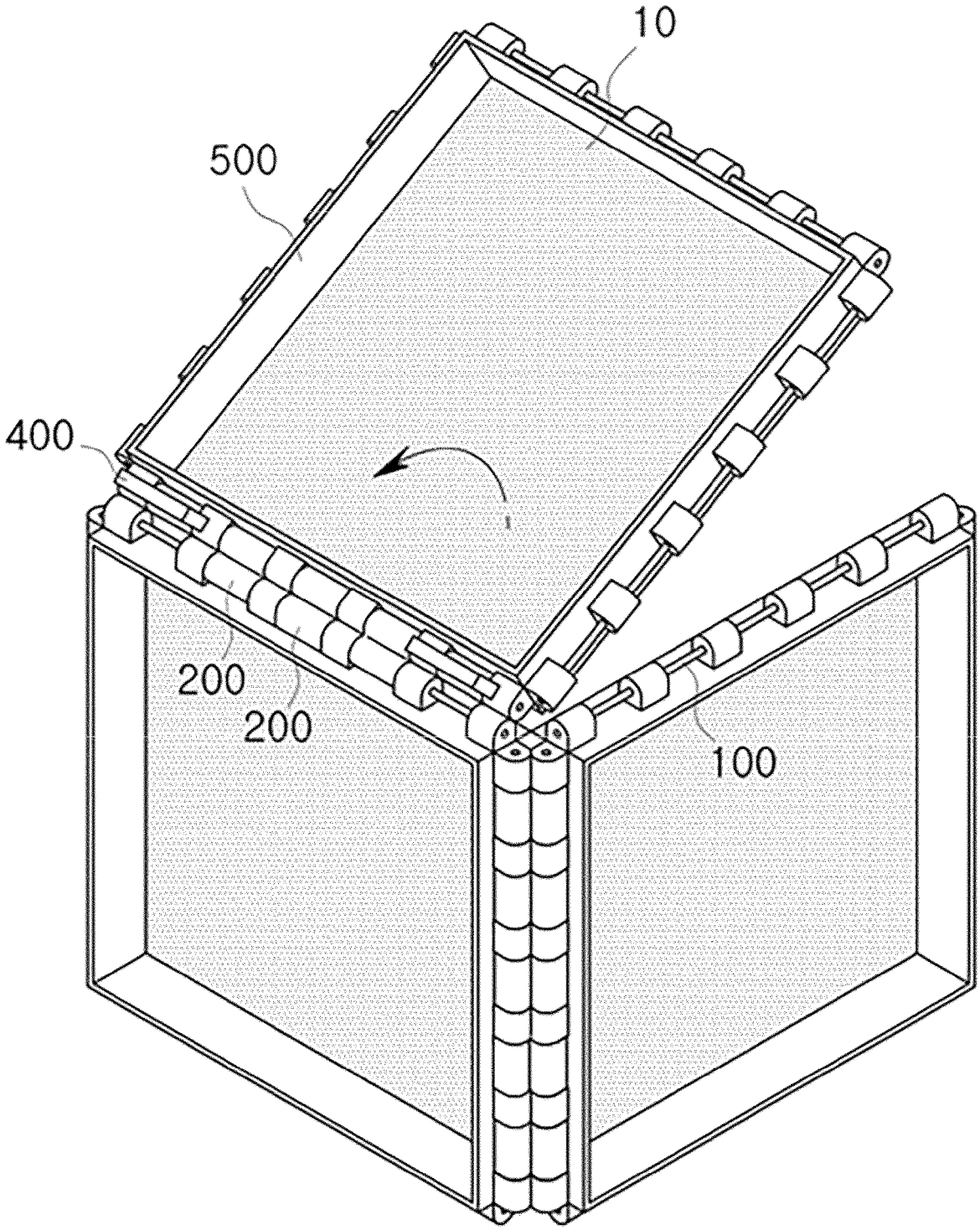
FIG. 11 is a perspective view showing that one outer body is rotated in a state where the storage container according to the second embodiment of the present disclosure is partially assembled.

In the present disclosure, the outer body 10 may be formed in the shape of a plate or a hollow vessel, and at least two outer bodies 10 may be coupled to form an accommodation space for accommodating an article therein while defining the entire appearance of the storage container. As one example, as shown in FIGS. 1 and 2, the outer bodies 10 each having the shape of a vessel that is hollow therein and is open at a side thereof may be vertically arranged to define the accommodation space therein, thereby forming the storage container. As another example, as shown in FIGS. 9 to 11, a plurality of outer bodies 10 each having the shape of a plate may be arranged to form a polyhedron that has the accommodation space therein, thereby forming the storage container. Although the outer body 10 may be formed to have a circular or polygonal cross-section, it is preferable that the outer body 10 have the polygonal cross-section in consideration of the easy coupling of the axis-determining clip 200 that will be described later and various opening directions. Hereinafter, this is explained as a premise.

The cord member 100 may be formed to have the shape of a thin tube, and may be made of, for example, wire. The cord member 100 is provided along an edge of the outer body 10. The cord member may be provided along an inner edge of the outer body 10 as well as an outer edge of the outer body 10. However, it is preferable that the cord member 100 be provided along the outer edge of the outer body 10, as shown in FIGS. 1, 2, 9 and 10, so that the user can easily couple or release the axis-determining clip 200 that will be described later.

The cord member 100 is provided along the outer edge of the outer body 10. In this regard, in order to enable the rotation of the outer body 10 in a state where the axis-determining clip 200 is coupled, the cord member is spaced apart from an outer circumference (or circumferential surface) of the outer body 10 by a predetermined distance. As one example, a plurality of fixing pieces may be formed along the outer edge of the outer body 10 at a predetermined interval to protrude outward from the outer circumference (or circumferential surface) of the outer body 10, and the cord member 100 may be provided to pass through the plurality of fixing pieces. As another example, as shown in FIGS. 1 and 2, the storage container according to the present disclosure may further include a fixing frame 500 that is formed in a shape corresponding to that of the outer circumference (or circumferential surface) of the outer body 10 to be coupled to the outer circumference (or circumferential surface) of the outer body 10. A plurality of cord-member holders 510 may be formed at a predetermined interval along an outer edge of the fixing frame 500 to protrude outward from the outer circumference of the fixing frame 500, and the cord member 100 may be provided to pass through the plurality of cord-member holders 510.

As described above, since the cord member 100 provided along the outer edge of the outer body 10 has a polygonal shape corresponding to the cross-section of the outer body 10, the cord member has a plurality of sides. Further, as one example, the cord member 100 may be formed such that one wire has a polygonal shape. As another example, the cord member may be formed to have a polygonal shape such that each wire forms one side of the cord member 100 and a plurality of wires passes through the fixing pieces or the cord-member holders 510.

Figure 3A:
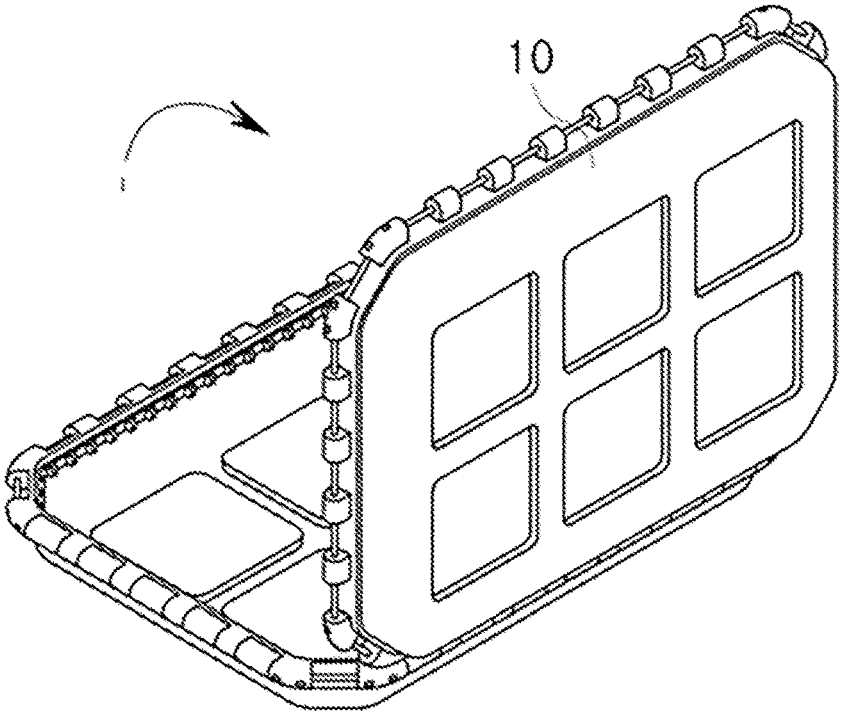
FIGS. 3A and 3B are exemplary views showing that the storage container according to the first embodiment of the present disclosure may be opened in various directions.
Figure 3B:
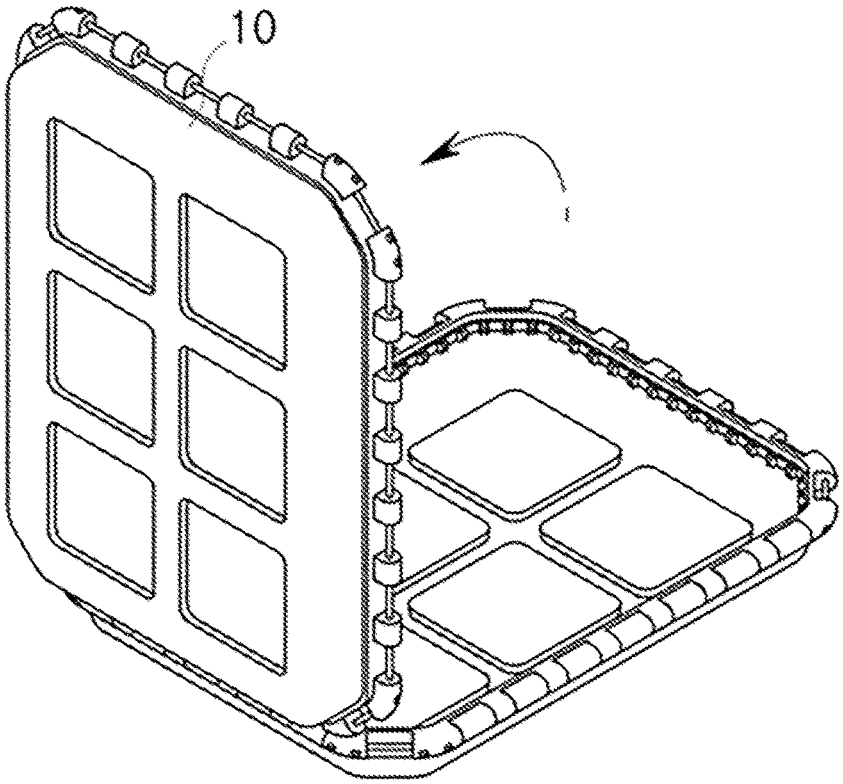

As shown in FIGS. 1 and 2, the axis-determining clip 200 is coupled such that cord members 100 provided, respectively, on adjacent outer bodies 10 simultaneously pass therethrough. In this case, as the axis-determining clip 200 is coupled to at least one side among the plurality of sides forming the cord member 100, the outer bodies 10 coupled by the axis-determining clip 200 may rotate about the axis-determining clip 200 to open the storage container. Thus, a user may select at least one side among the plurality of sides forming the cord member 100 as the rotation axis for opening the storage container and then may couple the axis-determining clip 200 thereto, thus allowing the opening direction to be changed depending on the type of an article that is to be stored or the purpose of use, as shown in FIGS. 3A and 3B.

Figure 4A:
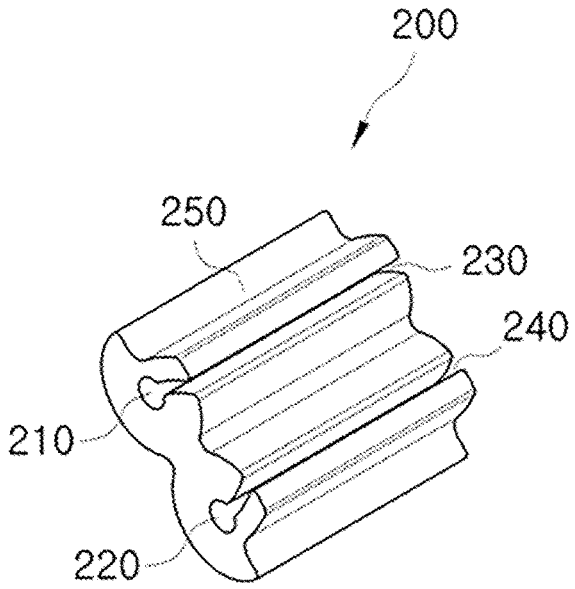
FIGS. 4A-4D are perspective views showing the structures of an axis-determining clip, a finishing clip, and a strap fixing clip applied to the storage container according to the present disclosure.
Figure 4B:
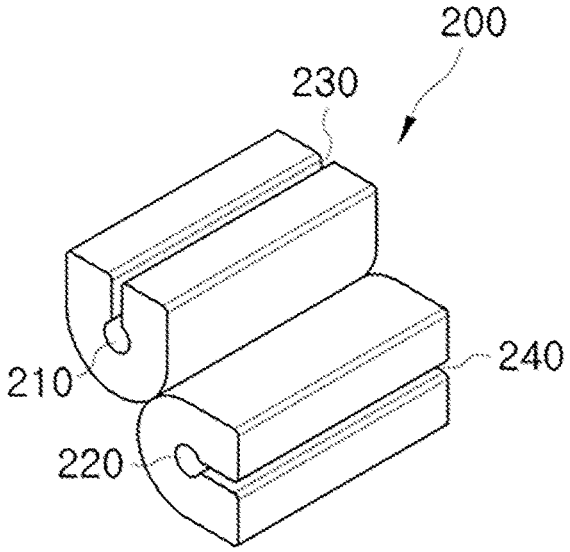
Figure 5:
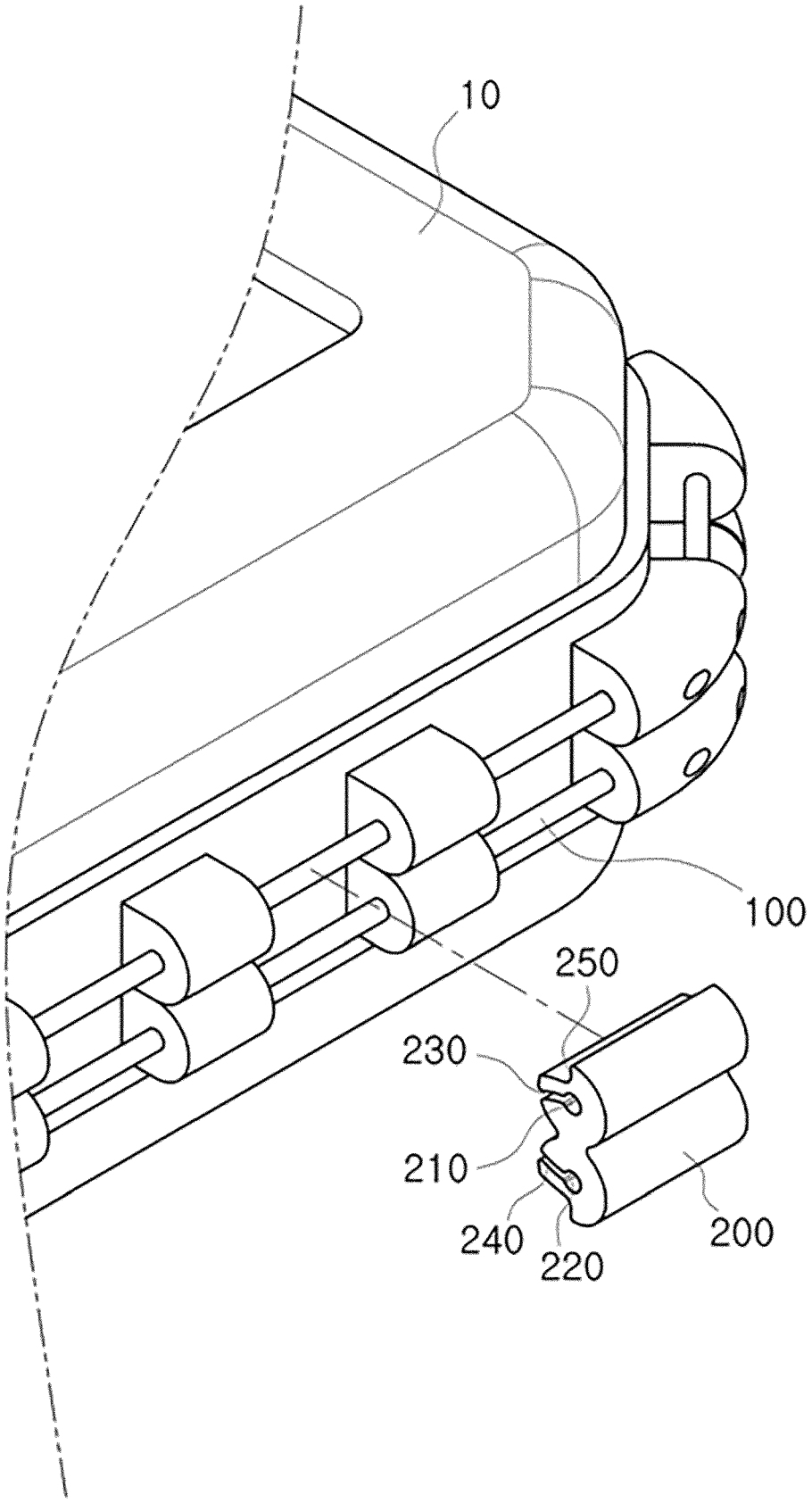
FIG. 5 is an exemplary view showing that the axis-determining clip is coupled to the storage container according to the first embodiment of the present disclosure.

That is, the axis-determining clip 200 should be configured so as not to interfere with the rotation of the outer body 10 even if the cord members 100 provided, respectively, on the adjacent outer bodies 10 simultaneously pass therethrough. Thus, the axis-determining clip is formed to be relatively smaller than the outer body 10. As one example, as shown in FIGS. 4A, 4B, and 5, the axis-determining clip 200 may be formed to accommodate both the adjacent cord members 100 therein while having a length corresponding to the interval between the plurality of fixing pieces or the plurality of cord-member holders 510. Preferably, the outer surface of the axis-determining clip 200 is formed to correspond to the outer surfaces of adjacent fixing pieces or adjacent cord-member holders 510, thus inhibiting a sense of difference from being created when the axis-determining clip 200 is coupled. Further, in order not to interfere with the outer body 10 that is rotated about the axis-determining clip 200, the outer surface of the axis-determining clip 200 with which the rotated outer body 10 may contact may be indented to form an anti-jamming part 250. Such an anti-jamming part 250 may not only inhibit the outer body 10 to smoothly rotate because it inhibits the outer body from contacting the axis-determining clip 200 when the outer body rotates, but also limit the rotation angle of the outer body 10.

The axis-determining clip 200 may be coupled to the cord member 100 or released from the cord member 100 by separating the cord member 100 from the fixing piece or the cord-member holder 510. However, for the convenience of coupling and releasing, it is preferable to couple the axis-determining clip to the cord member 100 through tight fitting.

As a specific example, the axis-determining clip 200 may include a first through hole 210 and a second through hole 220 formed in a longitudinal direction so that the cord members 10 provided on one outer body 10 and the other outer body 10 adjacent thereto pass therethrough as shown in FIGS. 4A, 4B, and 5, and a first fitting hole 230 and a second fitting hole 240 formed in a widthwise direction so that the first through hole 210 and the second through hole 220 communicate with the outside. Here, the first through hole 210 and the second through hole 220 are formed to have diameters corresponding to a diameter of the cord member 10, and the first fitting hole 230 and the second fitting hole 240 are formed to have widths smaller than the diameter of the cord member 10. Thus, it is preferable that the axis-determining clip 200 fitted over the cord member 100 through the first fitting hole 230 and the second fitting hole 240 is not easily separated.

Further, as shown in FIGS. 4A and 5, the first fitting hole 230 and the second fitting hole 240 may be formed to face the cord member 100 of one outer body 10 and the cord member 100 of the other outer body 10, which are coupled to the axis-determining clip 200. When the axis-determining clip 200 is inserted from the outside of the adjacent outer body 10 and the first fitting hole 230 and the second fitting hole 240 are formed such that the first through hole 210 and the second through hole 220 are aligned with the cord member 100 to be inserted therein, the axis-determining clip may be relatively easily removed when an outward force is applied to the axis-determining clip 200 fitted over the cord member 100. The above-described configuration may inhibit the undesirable removal of the axis-determining clip. That is, a distance between an outermost end of the first fitting hole 230 and an outermost end of the second fitting hole 240 is smaller than a distance between the cord members 100 provided on adjacent outer bodies 10. Thus, even if the outward force is applied to the axis-determining clip 200 fitted over the cord member 100, the axis-determining clip is not easily removed.

Figure 6:
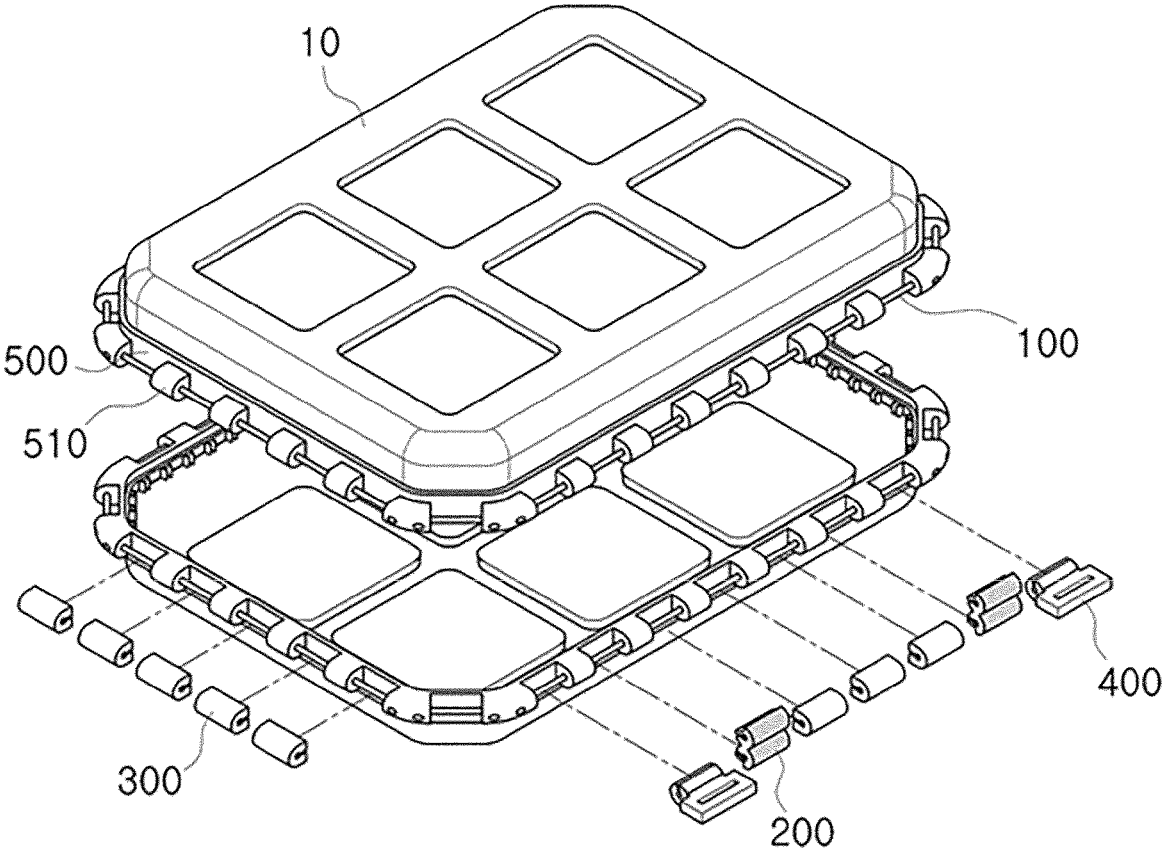
FIG. 6 is an exemplary view showing that the axis-determining clip, the finishing clip, and the strap fixing clip may be coupled to the storage container according to the first embodiment of the present disclosure.
Figure 7:
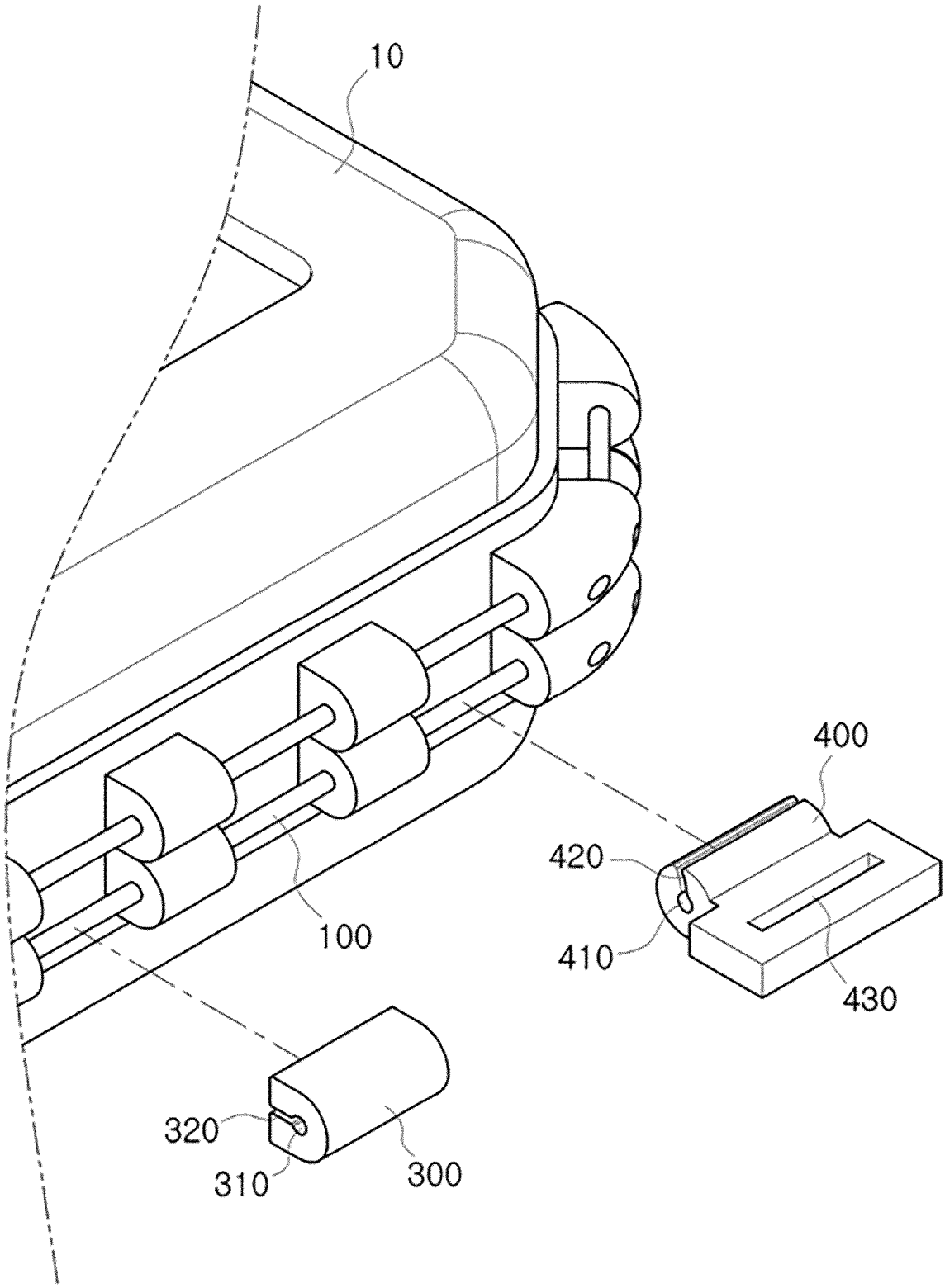
FIG. 7 is an exemplary view showing that the finishing clip and the strap fixing clip are coupled to the storage container according to the first embodiment of the present disclosure.
Figure 8:
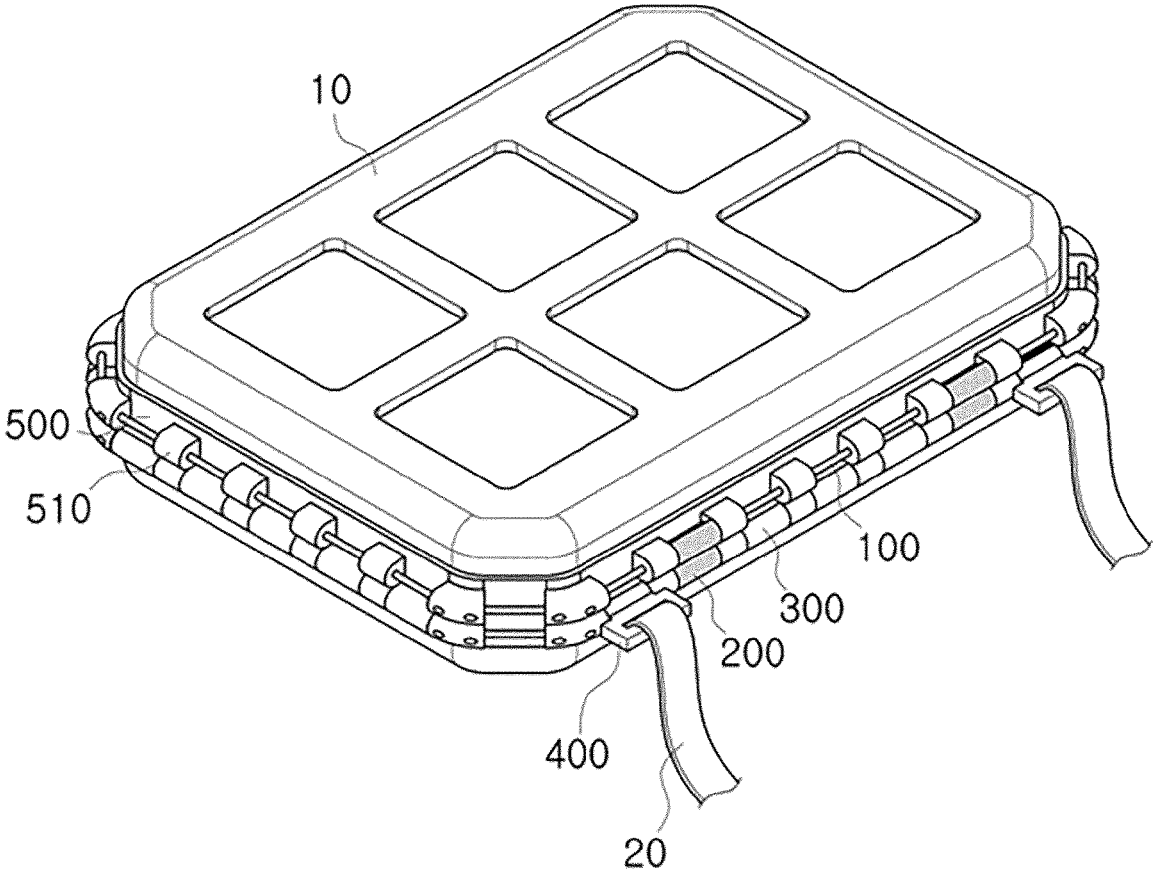
FIG. 8 is an exemplary view showing a state in which the axis-determining clip, the finishing clip, and the strap fixing clip are coupled to the storage container according to the first embodiment of the present disclosure.

Meanwhile, the storage container of the present disclosure is configured such that a user couples the axis-determining clip 200 to a portion of the cord member 100 to determine the opening direction. A portion of the cord member 100 forms a state in which the axis-determining clip 200 is not coupled. Thus, as shown in FIGS. 6 to 8, the storage container may further include a finishing clip 300 coupled to the portion of the cord member 100 to which the axis-determining clip 200 is not coupled. The finishing clip 300 is configured to be coupled to a portion of the cord member 10 that is provided on any one outer body 10 among adjacent outer bodies 10.

Figure 4C:
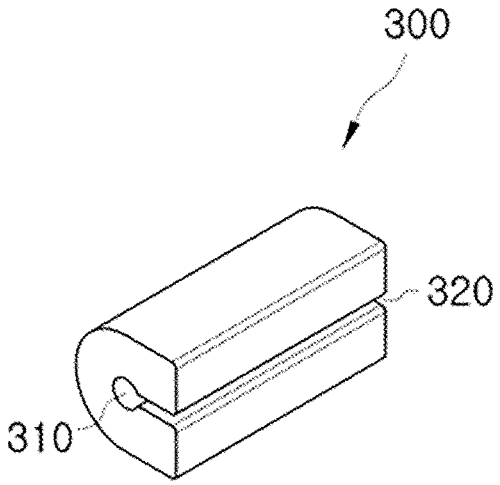

The finishing clip 300 is formed so as not to interfere with the rotation of the outer body 10 by the axis-determining clip 200. For example, as shown in FIGS. 4C and 7, the finishing clip 300 may be formed to accommodate the cord member 100 provided on one outer body 10 therein while having a length corresponding to the interval between the plurality of fixing pieces or the plurality of cord-member holders 510. The outer surface of the finishing clip may be formed to correspond to the outer surfaces of adjacent fixing pieces or adjacent cord-member holders 510. Further, the finishing clip 300 may be coupled to or released from the cord member 100 by separating the cord member 100. However, a third through hole 310 may be formed in a longitudinal direction such that the wire member 100 provided on one outer body 10 passes therethrough, and a third fitting hole 320 may be formed in a widthwise direction such that the third through hole 310 communicates with the outside. Thus, the cord member 100 may be fitted through the third fitting hole 320 to be located in the third through hole 310.

As described above, the finishing clip 300 is coupled to the portion of the cord member 100 to which the axis-determining clip 200 is not coupled, thus inhibiting the portion of the cord member 100 to which the axis-determining clip 9200 is not coupled from being exposed, thus securing a good appearance.

In addition, the present disclosure may be configured to allow a user to freely determine a location on which an accessory, such as the handle for holding the storage container by hand or the strap serving as a shoulder strap for carrying the storage container with the shoulder, is mounted. For example, as shown in FIGS. 6 to 8, the storage container may further include a strap fixing clip 400 to which the cord member 100 provided on at least one outer body 10 among the adjacent outer bodies 100 is coupled to penetrate therethrough, and which fixes a strap 20.

Figure 4D:
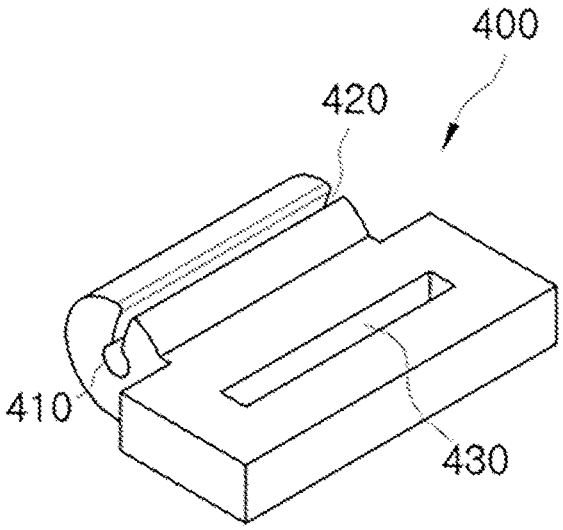

As a specific example, as shown in FIGS. 4D and 7, the strap fixing clip 400 may be formed to accommodate the cord member 100 provided on one outer body 10 therein while having a length corresponding to the interval between the plurality of fixing pieces or the plurality of cord-member holders 510. A strap coupling hole 430 may be formed through an outwardly extending portion such that the strap 20 may be fitted therein. Further, the strap fixing clip 400 may be coupled to or released from the cord member 100 by separating the cord member 100. However, a fourth through hole 410 may be formed in a longitudinal direction such that the wire member 100 provided on one outer body 10 passes therethrough, and a fourth fitting hole 420 may be formed in a widthwise direction such that the fourth through hole 410 communicates with the outside. Thus, the cord member 100 may be fitted through the fourth fitting hole 420 to be located in the third through hole 310.

Therefore, for example, in order to fix the strap fixing clip 400 provided on either end of the strap 20 to the storage container, a user may optionally select two spaced points on the cord member 100 and then couple the strap fixing clip 400 to each point, as shown in FIG. 8.

As described above, according to the present disclosure, the storage container can be variously formed as shown in FIGS. 1 to 11 depending on the shape and arrangement of the outer body 10, a user can optionally determine a direction in which the storage container is opened through the axis-determining clip 200, and can optionally determine the location of the accessory through the finishing clip 300 and/or the strap fixing clip 400, thus allowing the storage container to be appropriately changed depending on the article to be stored or the purpose of use.

DESCRIPTION OF MAIN ELEMENTS

10: outer body
20: strap
100: cord member
200: axis-determining clip
210: first through hole
220: second through hole
230: first fitting hole
240: second fitting hole
250: anti-jamming part
300: finishing clip
310: third through hole
320: third fitting hole
400: strap fixing clip
410: fourth through hole
420: fourth fitting hole
430: strap coupling hole
500: fixing frame
510: cord-member holder

What is claimed is:

1. A storage container comprising:

at least two outer bodies (10), each outer body in a shape of a plate or a hollow vessel while forming an appearance of the storage container, one outer body adjacent the other outer body;

a cord member (100) provided along an edge of each outer body (10); and an axis-determining clip (200) coupled to cord members (100) provided, respectively, on adjacent outer bodies (10) so that the cord members simultaneously penetrate therethrough, whereby, as the axis-determining clip (200) is coupled to at least one side among a plurality of sides forming the cord member (100), an outer body (10) coupled by the axis-determining clip (200) is rotatable about the axis-determining clip (200), thereby opening the storage container, while a separation distance between cord members within the axis-determining clip remains constant, wherein the axis-determining clip (200) comprises a first through hole (210) and a second through hole (220) that are formed in a longitudinal direction thereof so that the cord members (100) provided on one outer body (10) and the other outer body (10) adjacent thereto pass therethrough, and a first fitting hole (230) and a second fitting hole (240) that are formed in a widthwise direction thereof so that the first through hole (210) and the second through hole (220) communicate with the outside, whereby the axis-determining clip (200) is fitted over the cord member (100) through each of the first fitting hole (230) and the second fitting hole (240), wherein the first through hole (210) and the second through hole (220) are formed to have diameters corresponding to a diameter of the cord member (10), wherein the first fitting hole (230) and the second fitting hole (240) face the cord member (100) of one outer body (10) and the cord member (100) of the other outer body (10) and are formed to have widths smaller than the diameter of each of the cord members (100), such that a distance between the respective outermost ends thereof is smaller than the distance between the cord members (100) provided on one outer body (10) and the outer body (10), and in the outer surface of the axis-determining clip (200) which can contact the rotated outer body (10), portions corresponding to the first fitting hole (230) and the second fitting hole (240) are indented inwardly, thereby forming an anti-jamming part (250).

2. The storage container of claim 1, further comprising:

a finishing clip (300) coupled to a portion of the cord member (100) to which the axis-determining clip (200) is not coupled, without interfering with rotation of the outer body (10) by the axis-determining clip (200).

3. The storage container of claim 1, wherein each cord member (100) is provided along an outer edge of a respective outer body (10) of the outer bodies, and further comprising:

a strap fixing clip (400) to which the cord member (100) provided on at least one outer body (10) among the adjacent outer bodies (10) is coupled to penetrate therethrough, the strap fixing clip fixing a strap (20).

* * * * *